United States Patent [19]

Wagner et al.

[11] 4,086,783

[45] May 2, 1978

[54] REFRIGERATING CHAMBER

[75] Inventors: Richard C. Wagner, Frankfort; Horst M. Spaeth, Park Forest, both of Ill.

[73] Assignee: Hollymatic Corporation, Park Forest, Ill.

[21] Appl. No.: 750,893

[22] Filed: Dec. 15, 1976

[51] Int. Cl.[2] ..... F25D 17/02

[52] U.S. Cl. ..... 62/374; 62/380; 312/214; 312/236

[58] Field of Search ..... 62/63, 266, 345, 374, 62/375, 380; 312/214, 236

[56] References Cited

U.S. PATENT DOCUMENTS

| | | | |
|---|---|---|---|
| 3,376,710 | 4/1968 | Hirtensteiner | 62/380 |
| 3,528,259 | 9/1970 | Saal | 62/380 |
| 3,892,104 | 7/1975 | Klee et al. | 62/380 |

*Primary Examiner*—Ronald C. Capossela
*Attorney, Agent, or Firm*—Wegner, Stellman, McCord, Wiles & Wood

[57] ABSTRACT

An apparatus for refrigerating articles of the nature of food materials tending to give off waste including both liquid and solid comprising top, bottom and side walls forming a thermally isolated refrigerating tunnel or chamber. These boundary walls include a flat bottom wall and one side wall forming a bottom L-shaped structure having an outer edge that is opposite the one wall and a complementary top wall and second side wall located opposite to the one side wall forming a top L-shaped structure. These two L-shaped structures are complementary to each other to form a rectangular chamber and are mounted for opening and closing movement relative to each other so that when closed they define a closed tunnel and when open expose the interior of the chamber including the bottom wall and an outer smooth edge thereof for cleaning. There is also provided a conveyor in the chamber for conveying the food materials therethrough and spray means in the chamber for spraying articles on the conveyor with a liquid refrigerant. The bottom wall is flat and smooth out to the outer edge for easy cleaning when the top L-shaped structure is in open position.

10 Claims, 8 Drawing Figures

REFRIGERATING CHAMBER

CROSS REFERENCE TO RELATED APPLICATION

The apparatus comprising the refrigeration system is described and claimed in the copending application of Richard C. Wagner Ser. No. 750,892, filed Dec. 15, 1976 assigned to the assignee hereof.

BACKGROUND OF THE INVENTION

This invention relates to an apparatus for refrigerating articles comprising a thermally isolated chamber having top, bottom and side boundary walls including a flat bottom wall and one side wall forming a bottom L-shaped structure having an outer edge that is opposite the one side wall and a top L-shaped structure comprising a top wall and a second side wall located opposite to the one side wall with means mounting the top and bottom L-shaped structures for opening and closing movement relative to each other to define a closed tunnel and to expose selectively the interior of the chamber including the bottom wall, a fluid permeable conveyor in the chamber and spray means in the chamber for spraying articles on the conveyor with a liquid refrigerant, the bottom wall being flat and smooth out to its outer edge that is opposite the the one side wall and means for retaining the conveyor in elevated position above the bottom wall so that when the top structure is open the bottom wall which is smooth out to the outer edge is readily available for easy cleaning.

DESCRIPTION OF THE PREFERRED EMBODIMENT

Figure 1:
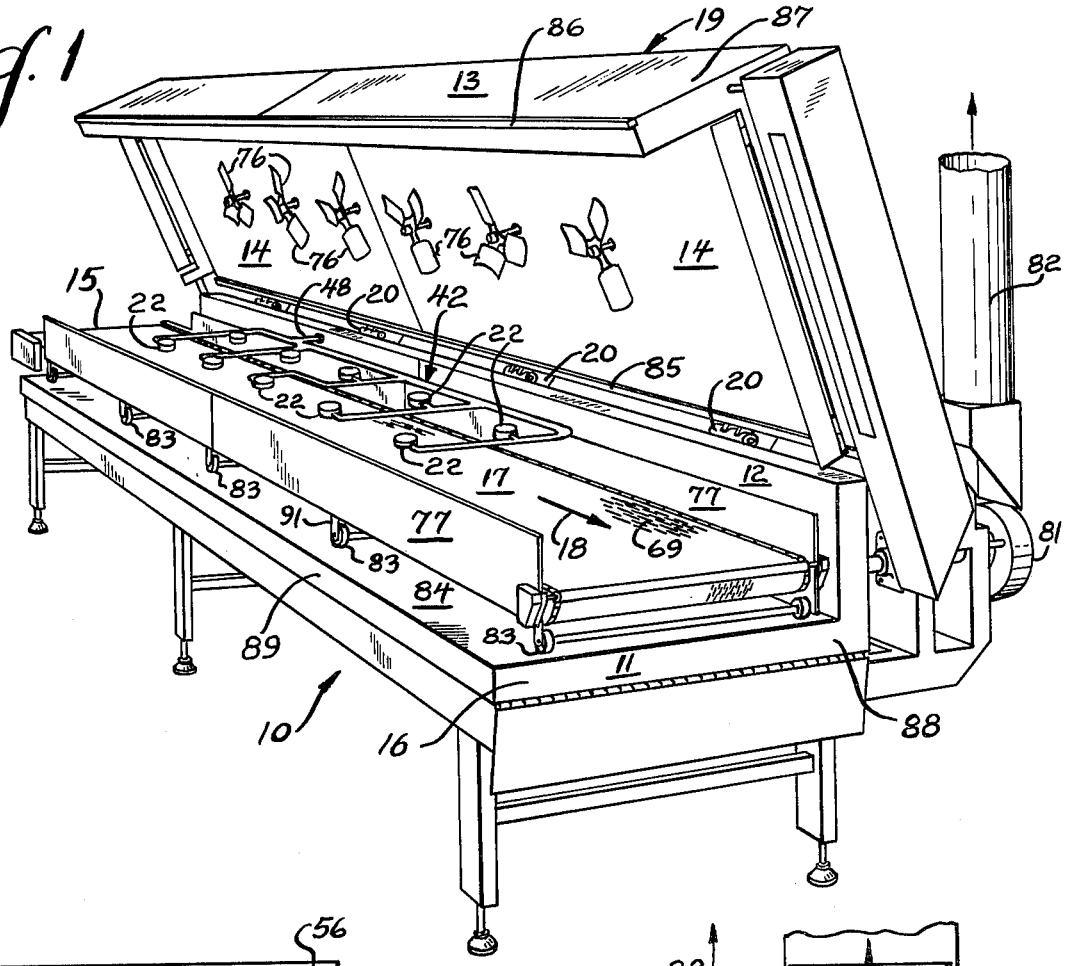
FIG. 1 is a perspective view of an apparatus embodying the invention with the lid of the chamber or tunnel in elevated position.

In the illustrated embodiment the apparatus 10 for refrigerating articles with a cryogen that is liquid at pressures above critical and converts to a solid at pressures below critical, of which carbon dioxide is a good example, comprises an elongated chamber that is thermally isolated by an insulated bottom 11, side walls 12 and 13, and top wall 14 that serve as boundary walls for thermally isolating the interior of the chamber. The chamber has an entrance end 15 and an exit end 16 for passage of articles through this chamber.

Located in the chamber is a conveyor 17 that is preferably of very closely spaced wire mesh and that is driven in the customary manner in the direction indicated by the arrow 18 to convey the articles to be refrigerated such as meat products to be frozen through the chamber.

Figure 2:
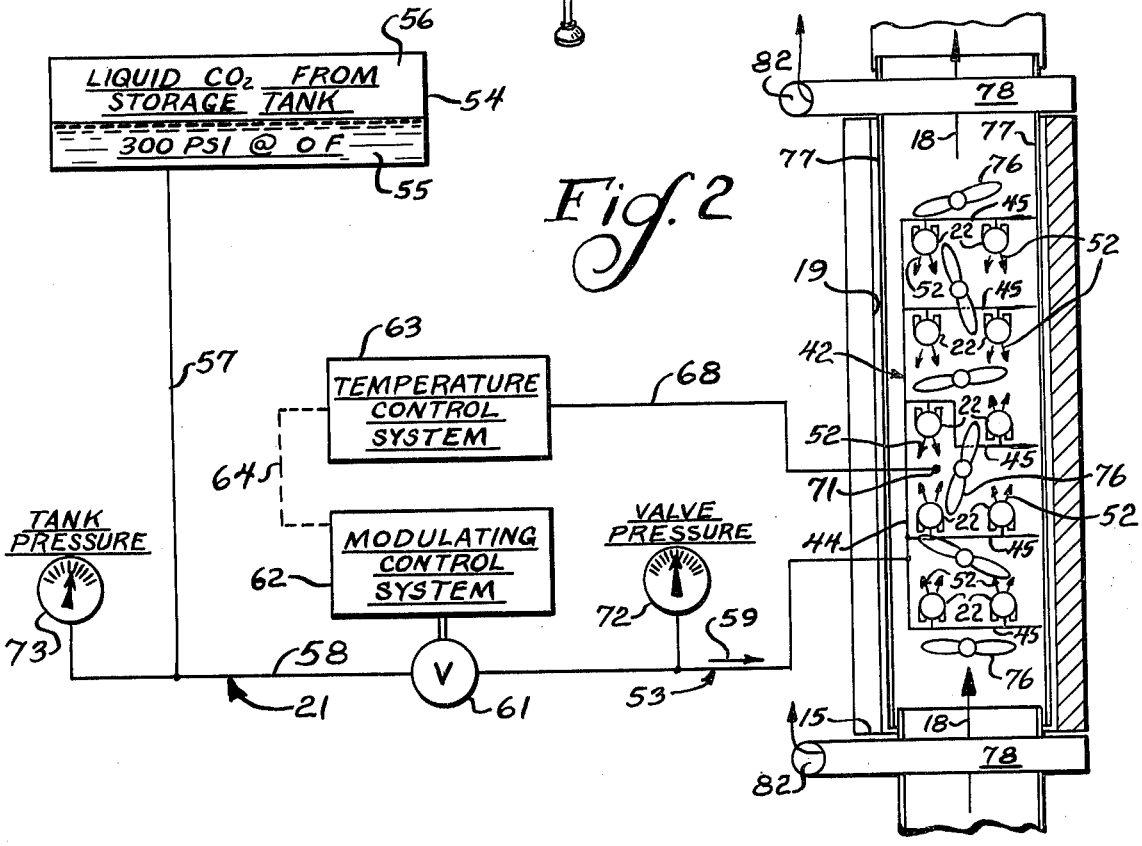
FIG. 2 is a semi-schematic view showing the arrangement of circulating fans and valves in the closed chamber and illustrating the supplying of liquid carbon dioxide to the chamber.
Figure 3:
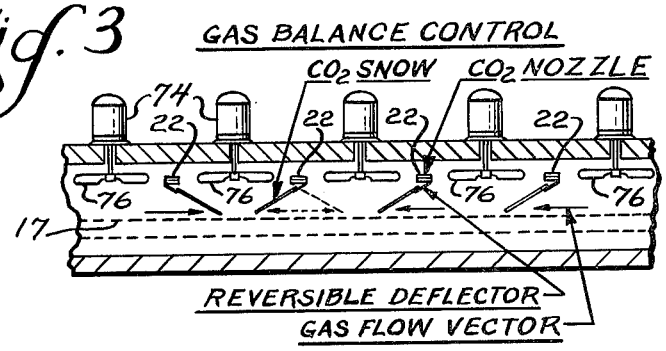
FIG. 3 is a longitudinal sectional view through a portion of the closed chamber.
Figure 6:
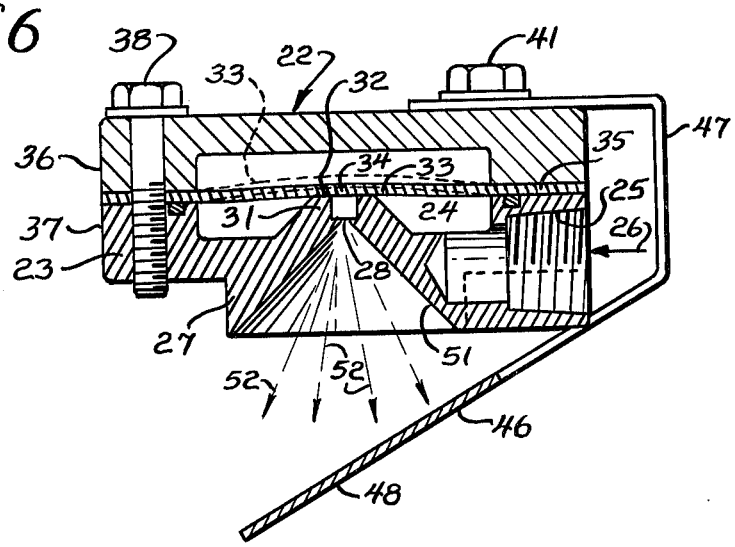
FIG. 6 is a transverse sectional view through one control valve and attached deflector member of the illustrated embodiment and taken substantially along line 6—6 of FIG. 7.
Figure 7:
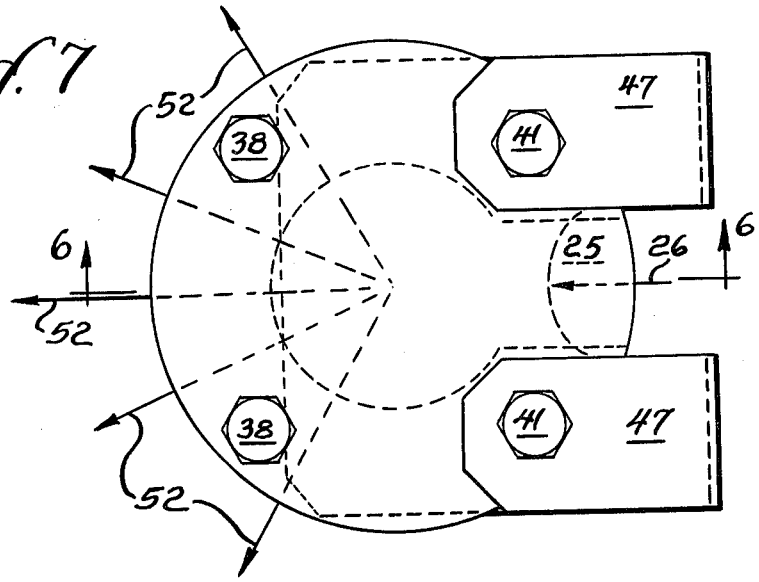
FIG. 7 is a plan view of the valve and deflector of FIG. 6.

The apparatus also includes introducing means 21 comprising a plurality of spaced pressure operated control valves 22 arranged across the length and the breadth of the chamber as illustrated in FIG. 2. Each valve as is shown in detail in FIGS. 6 and 7 comprises a valve body having a cavity 24 within the body for liquid cryogen flowing into the cavity through an opening 25 as illustrated in FIG. 6 by the arrow 26. The valve also includes a wall 27, here shown as a bottom wall, containing a liquid flow opening 28 for expelling liquid cryogen from the valve cavity 24. This opening 28 is surrounded by an inwardly extending wall portion 31 having an annular inner surface 32.

Within the valve cavity 24 is a pressure operated closure member 33, here shown as a diaphragm which may be made of aluminum or other suitable material, with a center portion 34 biased toward valve closing position as shown in FIG. 6 and a peripheral portion 35 clamped between the upper and lower valve parts 36 and 37 and retained there by the securing bolts 38 and 41. In one embodiment of such a diaphragm using liquid carbon dioxide as the liquid cryogen the peripheral portion 35 was 0.062 inch thick aluminum and was 0.006 inch higher at the center 34. This higher center 34 as shown in solid lines in FIG. 6 biased the diaphragm toward closed position.

Means are provided operated by the liquid cryogen within the cavity 24 which surrounds each valve opening 28 and on the underside of each diaphragm 33 for raising all diaphragms to open positions illustrated by dotted lines for the one valve in FIG. 6. This means comprises the inlet 25 for the liquid flow 26 and a network 42 of pipes 45 supplying the valves. As can be seen in FIG. 2, these pipes of the network comprise a longitudinally extending main supply pipe 44 and laterally extending branch pipes 45 extending therefrom in parallel each leading to and supporting a pair of valves 22. These valves are so arranged that they span the width and a substantial portion of the length of the thermally isolated chamber 19.

Each valve body 23 has attached to it by a pair of bolts 41 an angled deflector member or plate 46. As illustrated, each plate 46 has a pair of spaced parallel tabs 47 each held by a bolt 41 and each angled downwardly and around the valve on opposite sides of the opening 25. The tabs 47 are integral with the deflector bottom plate 48 that is angled forwardly and away from the bottom wall 27 of the valve.

The deflector bottom 48 that is thusly angled is directly beneath the liquid flow opening 28 which is surrounded by an outwardly expanding conical surface 51 in the bottom wall 27 so as to provide a similar spray pattern 52 to the ejected cryogen.

The mounting means for the multiplicity of valves which comprises the pipe network 42 arranges the valves so that all valves project the spray pattern 52 longitudinally toward the center of the chamber 19. This is illustrated by the arrows 52 in FIG. 2.

As can be seen therefore, the network 42 including the pipes 44 and 45 comprise liquid flow means interconnecting the plurality of control valves for flow of the cryogen liquid to all of the cavities of the valves.

The network pipes also provide means for spacing the valves in the chamber 19 above the conveyor 17 as illustrated in FIG. 1 and inwardly of the chamber entrance 15 and exit 16 as illustrated in FIGS. 1 and 2. This pipe network also comprises the means for spacing the valves from each other in the chamber so as to project the cryogen solids in the pattern 52 across the full width and a major portion of the length of the chamber.

The apparatus also comprises means 53 for selectively supplying the liquid flow means 44–45 with liquid cryogen at a pressure that is above critical pressure. This means for supplying the liquid cryogen comprises a source of liquid carbon dioxide such as a tank 54 (FIG. 2) having a bottom liquid containing space and a top 56 carbon dioxide vapor space together with a pipe 57 leading from the tank bottom to a pipe 58 leading to the pipe network 42 in the chamber 19.

Figure 5:
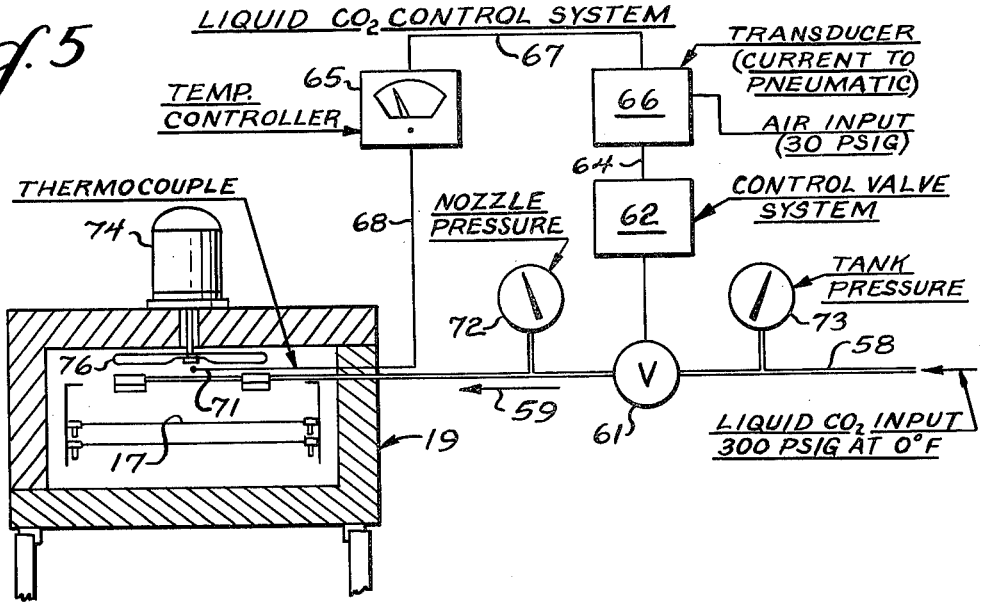
FIG. 5 is a schematic view of the liquid carbon dioxide control system of the illustrated embodiment.

Flow 59 of liquid carbon dioxide from the tank 54 and through pipes 57 and 58 to the network 42 of pipes supplying the spaced valves 22 within the chamber is controlled by a control valve 61 in pipe line 58 with this valve 61 being controlled by a modulating control system 62 that is regulated by a temperature control system 63 operatively connected to it as indicated at 64 by the dotted connecting line in FIG. 2 and in solid line in FIG. 5. The temperature control system 63 includes a temperature controller 65 as shown in FIG. 5 and also includes an air input unit 66 that operates through a transducer to convert current to pneumatic power for controlling the modulating valve portion 61–62. As can be seen in FIG. 5, this transducer is connected by a line 67 to the temperature controller 65 which in turn is connected by a lead wire 68 to a thermocouple 71 positioned at about the center of the tunnel 19 in the refrigerating space above the conveyor 17 as shown in FIG. 5 and in FIG. 2.

The liquid carbon dioxide supply 53 also is provided with a pressure gauge 72 connected to the line 58 between the control valve 61 and the pipe network 42 and a pressure gauge 73 connected to the line 57–58 between the valve 61 and the cryogen tank 54. The gauge 72 therefore indicates the pressure of the cryogen in supply network 42 including the spaced valves 22 while the gauge 73 indicates the pressure in the supply from and within the tank 54.

In order to insure uniform cooling the top or lid 14 of the chamber is provided with a series of longitudinally spaced motors 74 each having a shaft 75 extending downwardly to within the chamber 19 and operating a circulating blower, specifically a fan 76. As indicated by the flow arrows 79 in FIG. 4, these circulating fans 76 force the solid particles and carbon dioxide gas down through the open mesh 69 conveyor 17, around the side plates 77 where they are spaced above the bottom 84 or floor and back up into the fans 76 to complete one cycle of the recirculation. This not only insures even distribution of the solid and gaseous cryogen over and around the product transported through the chamber 17 but also aids the extraction of heat from the product being refrigerated such as freezing meat patties.

Figure 4:
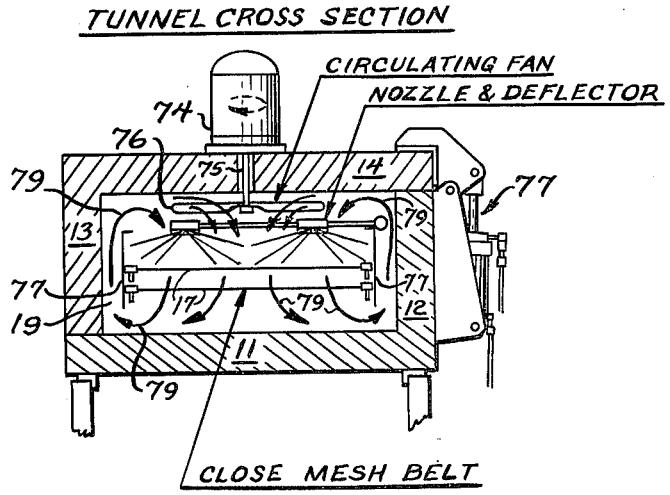
FIG. 4 is a transverse schematic sectional view in the vicinity of a circulating fan and motor.

As can be seen in FIG. 4, each top 14 and attached side wall 13 of the chamber can be moved between the elevated position of FIG. 1 and the closed position of FIG. 4 by motor operated side linkages and hinge structures 77 as is common in this industry.

During operation the thermocouple 71 controls the supply of liquid carbon dioxide through pipes 57 and 58 to the interior pipe network 42 by operation of the temperature control ststem 71, 68, 65, 67, 66, 64 and 62. This control system is made up of standard model available parts and is similar to the temperature control system for liquid nitrogen described in prior U.S. Pat. No. 3,898,863, also assigned to the assignee hereof. Both there and here the supply of cryogen is controlled by a temperature control that regulates the introduction of the cryogen as a function of the temperature within the refrigerating chamber 19.

When the temperature in the chamber calls for more liquid carbon dioxide the valve 61 is opened and the liquid which is under a pressure that is at least the critical pressure, and a satisfactory operating pressure has been found to be about 300 psig at 0° F., is supplied through the lines 57 and 58 and the valve 61 to the supply valves 22 by means of the pipe network 42. The cryogen liquid flow 26 thereupon enters the cavity 24 in each valve 22 beneath the diaphragm 33 and the pressure is sufficient to lift the diaphragm to the dotted line position shown in FIG. 6 thereby projecting a conical spray 52 of cryogen which is a mixture of snow particles and gas onto the deflector plates 48 where the cryogen is fanned out across and longitudinally of the chamber as indicated by the arrows 52 in FIGS. 2 and 7. Complete uniform circulation of refrigerant and complete evaporation of the carbon dioxide snow is assured by the fans 76.

The carbon dioxide thereupon extracts heat from the articles moving through the chamber in the direction 18 and in so doing is converted completely into refrigerant gas. This gas together with mixed snow particles prior to complete sublimation is circulated through the conveyor and the articles thereon and around the sides 77 as previously described. The deflectors 48 that are closest to the opposite ends of the chamber are angled to project this spray away from the adjacent ends as indicated by the arrows in FIG. 2. This further provides that all of the particles of carbon dioxide are converted to the gas. Finally, this gas is drawn from each end 15 and 16 of the chamber 19 by gas collectors 78 and forced to the exterior by blowers 81 exhausting through exhaust pipes 82.

As can be seen from the above description, the apparatus of this invention provides an effective refrigeration structure of very simple design that uses readily available and relatively inexpensive liquid carbon dioxide as the cryogen or refrigerant. No complex seals are required, and the nozzles and their deflector plates not only prevent the carbon dioxide or similar cryogen setting up to a solid within the valve body but also provides good distribution of the solid as well as the gaseous cryogen across the conveyor and throughout the interior of the tunnel. The valves do not clog up with solid carbon dioxide as the pressure on the liquid within the valve body is maintained above the critical pressure until after the liquid cryogen has been emitted from the valve as explained above and as shown in FIGS. 6 and 7.

Although a large number of valves 22 are used, as can be seen in FIG. 2, this is not an important cost factor because each valve is of such simple design involving only a top 36, a bottom 37, a single metal diaphragm 33 and four fastening bolts 38 and 41 with two of these bolts also serving to hold the deflector plate 46 in position. In addition, the deflectors 46 are easily reversible as each can selectively be held by the pair of bolts 38 to extend in the opposite direction or from left to right in FIG. 6 rather than right to left as shown.

The chamber or tunnel structure itself is very important in the cost factor and also in the proper operation of the unit. Thus as can be seen in the drawings, the bottom wall 11 of the tunnel has a flat upper surface and one side wall 12. The opposite side wall 13 of the tunnel is attached to the top 14. Thus the tunnel or chamber is in two cooperating L-shaped units: 11–12 and 13–14 which when closed together (FIG. 4) form the enclosing structure. In addition, the supporting rollers for the conveyor 17 structure which rest on this flat surface as shown in FIG. 1 hold the conveyor structure including the side plates 77 elevated above this flat floor or bottom wall 84 so that when the tops are in their raised positions as shown in FIG. 1 the space beneath the conveyor 17 can be very easily cleaned as the whole bottom is exposed along one side out to the outer edge 89 with the conveyor structure held above the exposed bottom wall 11 by rollers 83.

The boundary walls of the chamber which comprise the bottom wall 11, side walls 12 and 13 and top wall 14 are arranged in two L-shaped structures. The bottom L-shaped structure comprises the bottom wall 11 which is flat at the top surface or floor 84 for easy cleaning and one side wall 12 attached thereto to form a rigid structure. The other or opposite side wall 13 and top wall 14 comprise a top L-shaped structure which when in closed position as shown particularly in FIG. 4 defines a closed tunnel. However, the hinges 20 permit opening the tunnel by raising the top of the chamber or tunnel 19 to the elevated position of FIG. 1 to provide access to the interior.

The L-shaped structure that is openable as illustrated in FIG. 1 in combination with spacing means comprising the rollers 83 and the downwardly extending standards 91 on which they are mounted facilitates easy cleaning of the interior of the structure. Thus the waste materials from the refrigerated products and particularly food materials such as raw hamburger patties may include both liquids and solids and pass down through the foraminous open mesh 69 of the conveyor 17. This dislodgement of the waste materials and their passage through the open mesh 69 is of course more pronounced because of the downward blast 79 from the circulating fans 76. However, with the chamber or tunnel of this construction as soon as the top or lid 87 is raised as shown in FIG. 1 the entire flat floor surface 84 is exposed, without break, out to the outer edge 89. It is then only a simple matter to hose down the conveyor 17 through the open mesh 69 and to clean off the floor surface with any desired cleaning fluid in the customary manner. As this surface is flat and smooth, there are no ridges, depressions, pockets or other areas where the waste materials can collect.

Figure 8:
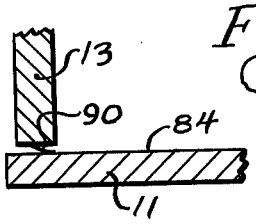
FIG. 8 is a fragmentary sectional view showing a second embodiment of a sealing means.

Sealing means such as the gaskets 85 and 86 are provided on the top L-shaped structures as illustrated in FIG. 1 so as to provide a seal at the adjacent edge portions of the top and bottom structures 87 and 88. Thus the rear gasket 85 at the rear edge of the top wall 14 seals against the top surface of the one side wall 12 while the other gasket 86 seals against the outer edge of the bottom surface or floor 84. These gaskets which extend longitudinally of the tunnel inhibit heat losses to the exterior. If desired, the sealing means may comprise spring metal strips 90 as illustrated in FIG. 8.

The rollers 83 not only support the conveyor structure 17 on the floor 74 but retain it in elevated position to provide the fluid refrigerant circulation previously described and illustrated by the arrows 79 in FIG. 4.

Another very important advantage of this simplified tunnel structure is that the one side wall 12 of the tunnel is fixed so that the supply pipe 48 extends through this fixed section and supports as a single unit the entire pipe and valve structure due to the rigidity of the pipes. This means that the unit comprising the network 42 and attached valves 22 may be built and inserted as a unit into the tunnel which makes it easy to assemble and also to convert existing refrigerating tunnels to this system.

As is well known, the temperature and pressure of a liquid cryogen such as liquid carbon dioxide are related, that is, as the temperature is raised the pressure must also be increased in order to maintain the liquid condition. Therefore, by supplying liquid carbon dioxide at 300 psig and 0° F., for example, a safe condition is maintained to provide instantly available liquid carbon dioxide to the system and to maintain it as a liquid thereby to prevent setting up of solids in the valves, as previously described. Only when the liquid is sprayed from the valves into the atmosphere within the tunnel does it convert to a snowgas.

Having described our invention as related to the embodiment set out herein, it is our intention that the invention be not limited by any of the details of description, unless otherwise specified, but rather be construed broadly within its spirit and scope as set out in the appended claims.

We claim:

1. Apparatus for refrigerating articles of the nature of food materials tending to give off waste materials, comprising: means defining a thermally isolated chamber having boundary walls and entrance and exit ends for passage of articles through said chamber, said boundary walls including a flat bottom wall and one side wall at one edge of said flat bottom wall forming a bottom L-shaped structure having an outer edge that is opposite said one edge and said one side wall and a top wall and a second side wall located opposite to said one side wall forming a top L-shaped structure; means mounting said top and bottom L-shaped structures for opening and closing movement relative to each other thereby to define a tunnel comprising said chamber and to expose selectively the interior of said chamber and said bottom wall and said outer edge; fluid permeable conveyor means in said chamber for said passage; and spray means in said chamber for spraying articles on said conveyor means with a liquid refrigerant, the said bottom wall being flat and smooth out to and including said outer edge for easy cleaning when said top L-shaped structure is in said open position.

2. The apparatus of claim 1 wherein there are provided yieldable sealing means for providing seals at adjacent edge portions of said L-shaped structures when said structures are in closed position, said sealing means being in addition to the sealing effect provided by said adjacent edge portions.

3. The apparatus of claim 2 wherein a said sealing means is located at the edge of the side wall comprising said top L-shaped structure for engaging said outer edge of the bottom wall comprising said bottom L-shaped structure.

4. The apparatus of claim 1 wherein there are provided spacing means for retaining said conveyor means in elevated position above said bottom wall for aid in said cleaning as well as in circulation of said refrigerant through the conveyor means and over said articles.

5. The apparatus of claim 1 wherein there are provided spacing means for retaining said conveyor means above said bottom wall, fixed vertical side plate members on opposite sides of said conveyor means spaced from the adjacent side walls of said chamber, and blowers for circulating flowable refrigerant through said conveyor means and over and between articles thereon, up between said side plates and said side walls and back into the blowers for efficient chilling of said articles during their said passage through said chamber, said circulating thereby tending to deposit said waste materials on said bottom wall.

6. The apparatus of claim 5 wherein said means retaining said conveyor means comprises rollers movable on said bottom wall.

7. The apparatus of claim 1 wherein there are provided sealing means for providing seals at adjacent edge portions of said L-shaped structures when said structures are in closed position, one of said sealing means being located at the edge of the side wall comprising said top L-shaped structure for engaging the bottom wall comprising said bottom L-shaped structure, means retaining said conveyor means above said bottom wall, fixed vertical side plate members on opposite sides of said conveyor means spaced from the adjacent side walls of said closed chamber, said conveyor means comprises a fluid permeable article supporting surface means, and blowers for circulating flowable refrigerant in repeated cycles through said surface means, over and between articles thereon, up between said side plates and said side walls and back into the blowers for efficient chilling of said articles during their said passage through said chamber, said circulating thereby tending to deposit said waste materials on said bottom wall.

8. Apparatus for refrigerating articles of the nature of food materials tending to give off waste materials, comprising: means defining a thermally isolated chamber having boundary walls and entrance and exit ends for passage of articles through said chamber, said boundary walls including a flat bottom wall and one side wall at one edge of said flat bottom wall forming a bottom L-shaped structure having an outer edge that is opposite said one edge and said one side wall and a top wall and a second side wall located opposite to said one side wall forming a top L-shaped structure; means mounting said top and bottom L-shaped structures for opening and closing movement relative to each other thereby to define a tunnel comprising said chamber and to expose selectively the interior of said chamber and said bottom wall and said outer edge; fluid permeable movable conveyor means in said chamber for said passage; spray means in said chamber for spraying articles on said conveyor means with a liquid refrigerant, the said bottom wall being flat and smooth out to and including said outer edge for easy cleaning when said top L-shaped structure is in said open position; yieldable sealing means for providing seals at adjacent edge portions of said L-shaped structures when said structures are in closed position, said sealing means being in addition to the sealing effect provided by said adjacent edge portions; and spacing means for retaining said conveyor means in elevated position above said bottom wall for aid in said cleaning as well as in circulation of said refrigerant through the conveyor means and over said articles.

9. The apparatus of claim 8 wherein a said sealing means is located at the edge of the side wall comprising said top L-shaped structure for engaging said outer edge of the bottom wall comprising said bottom L-shaped structure.

10. The apparatus of claim 8 wherein there are provided fixed vertical side plate members on opposite sides of said conveyor means spaced from the adjacent side walls of said closed chamber, and blowers for circulating flowable refrigerant through said conveyor means and over and between articles thereon, up between said side plates and said side walls and back into the blowers for efficient chilling of said articles during their said passage through said chamber, said circulating thereby tending to deposit said waste materials on said bottom wall.

* * * * *